US009181869B2

(12) United States Patent
Curtis et al.

(10) Patent No.: US 9,181,869 B2
(45) Date of Patent: Nov. 10, 2015

(54) MECHANICAL BREATHER SYSTEM FOR A FOUR-STROKE ENGINE

(75) Inventors: Andrew L. Curtis, Hope, AR (US); Jeffrey L. Osterchill, Texarkana, AR (US); Justin K. Murnan, Whitesboro, TX (US); Andrew Johnson, Texarkana, TX (US); Justin Wilkey, Coweta, OK (US); Greg S. Reeder, Cornelius, NC (US)

(73) Assignee: HUSQVARNA AB, Huskvarna (SE)

( * ) Notice: Subject to any disclaimer, the term of this patent is extended or adjusted under 35 U.S.C. 154(b) by 0 days.

(21) Appl. No.: 13/543,683

(22) Filed: Jul. 6, 2012

(65) Prior Publication Data

US 2013/0174803 A1 Jul. 11, 2013

Related U.S. Application Data

(63) Continuation-in-part of application No. PCT/US2011/020573, filed on Jan. 7, 2011, which is a continuation of application No. PCT/US2010/020508, filed on Jan. 8, 2010.

(51) Int. Cl.

| | |
|---|---|
| ***F02B 75/32*** | (2006.01) |
| ***F01M 13/00*** | (2006.01) |
| ***F02B 77/00*** | (2006.01) |

(Continued)

(52) U.S. Cl.

CPC ..... *F02B 77/00* (2013.01); *F01M 13/04* (2013.01); *F01B 9/047* (2013.01); *F01M 13/00* (2013.01); *F01M 13/02* (2013.01); *F01M 13/021* (2013.01); *F01M 2013/0422* (2013.01); *F01M 2013/0438* (2013.01); *F02B 9/06* (2013.01);

(Continued)

(58) Field of Classification Search

CPC ..... F01M 13/04; F01M 13/02; F01M 13/00; F01M 13/021; F01M 2013/0438; F02B 75/32; F02B 41/04; F02B 75/048; F01B 9/047; F01B 9/06

USPC ..... 123/197.1, 41.86

See application file for complete search history.

(56) References Cited

U.S. PATENT DOCUMENTS 6,047,678 A 4/2000 Kurihara et al.
6,279,553 B1 * 8/2001 Brueggemann et al. ..... 123/572

(Continued)

FOREIGN PATENT DOCUMENTS

DE 400341 C 8/1924

OTHER PUBLICATIONS

Paul Vermilyea, 1/2 V W Engine, Oct. 3, 2003, Paul Verilyea, 1/2 V W Engine.*

(Continued)

*Primary Examiner* — Lindsay Low
*Assistant Examiner* — Charles Brauch
(74) *Attorney, Agent, or Firm* — Nelson Mullins Riley & Scarborough LLP

(57) ABSTRACT

A mechanical breather system for a four-stroke engine includes a rotating member. The rotating member can have at least one inlet channel in fluid communication between an outer perimeter of the rotating member and an inner region of the rotating member. A breather housing having an air receiving chamber formed therein is fluidly coupled to the at least one inlet channel of the rotating member. A passage can be formed through a wall of the breather housing is in fluid communication with the air receiving chamber and an exterior of the breather housing.

20 Claims, 17 Drawing Sheets

(51) Int. Cl.

| | |
|---|---|
| *F02B 75/04* | (2006.01) |
| *F01M 13/02* | (2006.01) |
| *F02B 9/06* | (2006.01) |
| *F01B 9/04* | (2006.01) |
| *F02B 41/04* | (2006.01) |
| *F01M 13/04* | (2006.01) |

(52) U.S. Cl.
CPC ..... *F02B 41/04* (2013.01); *F02B 75/048* (2013.01); *F02B 75/32* (2013.01)

(56) References Cited

U.S. PATENT DOCUMENTS 6,584,964 B1 7/2003 Seilenbinder et al.
7,438,065 B2 * 10/2008 Matsushima et al. ..... 123/572

OTHER PUBLICATIONS

Notification of Transmittal of the International Search Report and the Written Opinion of the International Searching Authority, or the Declaration for International Application No. PCT/US2011/020573, dated Nov. 7, 2011, 1 page.
International Search Report for International Application No. PCT/US2011/020573, dated Nov. 7, 2011, 3 pages.
Written Opinion for International Application No. PCT/US2011/020573, Nov. 7, 2011, 6 pages.
Notification of Transmittal of the International Search Report and the Written Opinion of the International Searching Authority, or the Declaration for International Application No. PCT/US2011/020508, dated Nov. 2, 2011, 1 page.
International Search Report for International Application No. PCT/US2011/020508, dated Nov. 2, 2011, 3 pages.
Written Opinion for International Application No. PCT/US2011/020508, Nov. 2, 2011, 6 pages.

* cited by examiner

MECHANICAL BREATHER SYSTEM FOR A FOUR-STROKE ENGINE

CROSS REFERENCE TO RELATED APPLICATIONS

This application is a continuation-in-part application of International Patent Application No. PCT/US2011/020573, filed on Jan. 7, 2011, which is a continuation of International Patent Application No. PCT/US2010/020508, filed on Jan. 8, 2010; the contents of each of said applications are incorporated herein in its entirety for all purposes.

FIELD

This disclosure relates to four stroke engines, and more particularly, to ventilation of a crankcase for a four-stroke engine.

BACKGROUND

Four-stroke internal combustion engines can be used in outdoor power tools, such as line-trimmers, edgers, chain saws, blowers, and the like. Four-stroke internal combustion engines can also be used for powering vehicles, such as motor cycles, all-terrain vehicles, and the like. Typical four-stroke internal combustion engines include a crankcase, a cylinder communicating with the crank case, and a piston adapted to reciprocate within the cylinder. During the combustion process, gases can flow past the piston rings and create elevated pressure in the crankcase.

SUMMARY

A system and method of ventilating the crankcase is presented to alleviate and prevent pressure buildup in the crankcase. One embodiment takes the form of a four stroke engine having a mechanical breather system. The crankshaft of the four stroke engine can be supported to the engine by at least one bearing. The mechanical breather system can include a rotating member coupled to the crankshaft, a bearing, an air receiving chamber, and a passage through a wall of the air receiving chamber. The rotating member can have at least one inlet channel extending between an outer perimeter of the rotating member and an inner region of the rotating member. The mechanical breather system can also include a breather housing forming the air receiving chamber. A rotating member support member can be provided to position the rotating member, while it is being rotated, relative to the breather housing and the bearing.

During combustion, the crankshaft rotates within the crank case in conjunction with the reciprocation of the pistons. As the crankshaft rotates, the mechanical breather system coupled to the crankshaft can separate the oil and air within the crankcase. The centrifugal force resulting from the rotating inlet channels of the rotating member forces oil away from the center of the rotating member, but allows the air to enter the air receiving chamber. The air then passes from within the air receiving chamber to exterior of the crankcase. The passage of air as described above ventilates the crankcase, thereby reducing and/or alleviating crankcase pressure. The air from the crankcase can be run through one or more filters for example an air filter.

BRIEF DESCRIPTION OF THE DRAWINGS

The foregoing features of the disclosure will be more readily understood by reference to the following detailed description, taken with reference to the accompanying drawings, in which.

DETAILED DESCRIPTION

A mechanical breather system for a four-stroke engine adapted according to the present teachings will hereinafter be described more fully with reference to the accompanying drawings in which embodiments of the mechanical breather assembly are illustrated. The breather system can, however, be embodied in many different forms and should not be construed as limited to the embodiments set forth herein. Rather, these embodiments are provided so that this disclosure will be thorough and complete, and will fully convey the scope of the disclosure to those persons skilled in the art. In the figures and description, like reference numbers refer to like elements throughout.

Four-stroke engines can build crankcase pressure resulting from the reciprocation of the pistons during the engine's combustion processes. Excess crankcase pressure buildup can adversely affect fuel combustion. As described herein, a mechanical breather system is disclosed that provides a system to ventilate crankcase pressure. While the embodiments described herein focus on the implementation of the mechanical breather system for an outdoor power tool, other tools and machines having a four-stroke engine are also considered within the scope of this disclosure. For example, such tools and machines can include pressure cleaners, powered scooters, all-terrain vehicles, generators, and powered bikes.

A four-stroke engine creates power though combustion in one or more cylinders. The four-strokes are typically referred to as an intake stroke, compression stroke, combustion stroke and exhaust stroke. During the intake stroke, the piston moves downward from a top dead center position as a mixture of air and fuel is forced into the cylinder. In the compression stroke, the air and fuel mixture is compressed in the cylinder. A spark can be used for ignition if the four-stroke engine is a gasoline powered engine or other similar fuel mixture that is combustible based on a spark. In other instances, the compression coupled with sufficient heat can cause ignition. As the fuel burns, it produces one or more gases forcing the piston downward again. Then, during the exhaust stroke, the one or more gases are exhausted through an exhaust valve. During the compression stroke, the rings sealing the piston can allow the gasses to enter into the crankcase. Additionally, the motion of the piston within the cylinder can cause the crankcase to increase in internal pressure as the crankcase is fluidly coupled to bottom of the cylinder. As used herein, adjacent refers to close proximity of two or more components. In at least one implementation, adjacent is such that there exists direct fluid communication and in another example fluid communication occurs through a separate communicating member.

Figure 1:
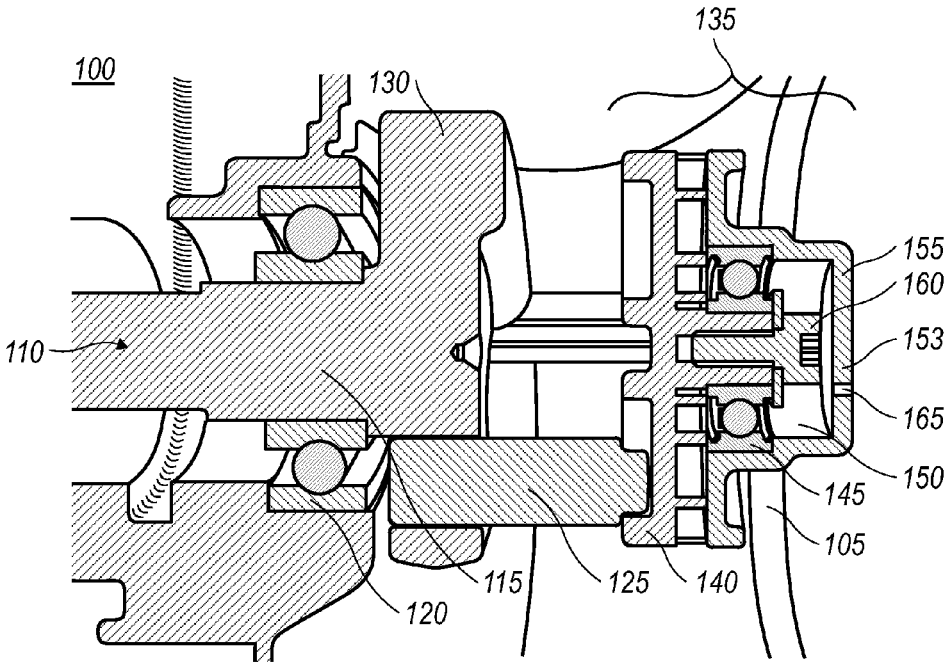
FIG. 1 is a cross-sectional of a four-stroke engine having an example of a mechanical breather assembly in accordance with an exemplary embodiment.

In order to more fully illustrate the present disclosure, some elements of the engine and crank case are omitted in the drawings to more fully disclose the relevant portions thereof. For example, the piston and cylinder have not been illustrated. FIG. 1 illustrates a cross-section of a four-stroke engine 100 including a crankcase 105. Additionally, a crankshaft 110 is illustrated. The crankshaft 110 rotates within the crankcase 105 as the piston (not shown) reciprocates within the cylinder. The piston can be coupled to the crankshaft via a connecting rod (not shown) which can be in turn coupled to the crankshaft 110. In a half-crank engine, the crankshaft 110 can be supported at one position by at least one bearing 120. Additionally, the rotating member 140 can be driven directly by the crankshaft 110 in that an extended crank pin serves as a connecting member 125 and drives the rotating member 140. The at least one bearing can be sealed, partially sealed or unsealed. The bearing allows the crankshaft 110 to more easily rotate due to the bearing providing less resistance than direct contact with another fixed part. While a half-crank engine is illustrated herein, the mechanical breather system 135 as presented herein can be implemented with a full crank engine as well.

Figure 2:
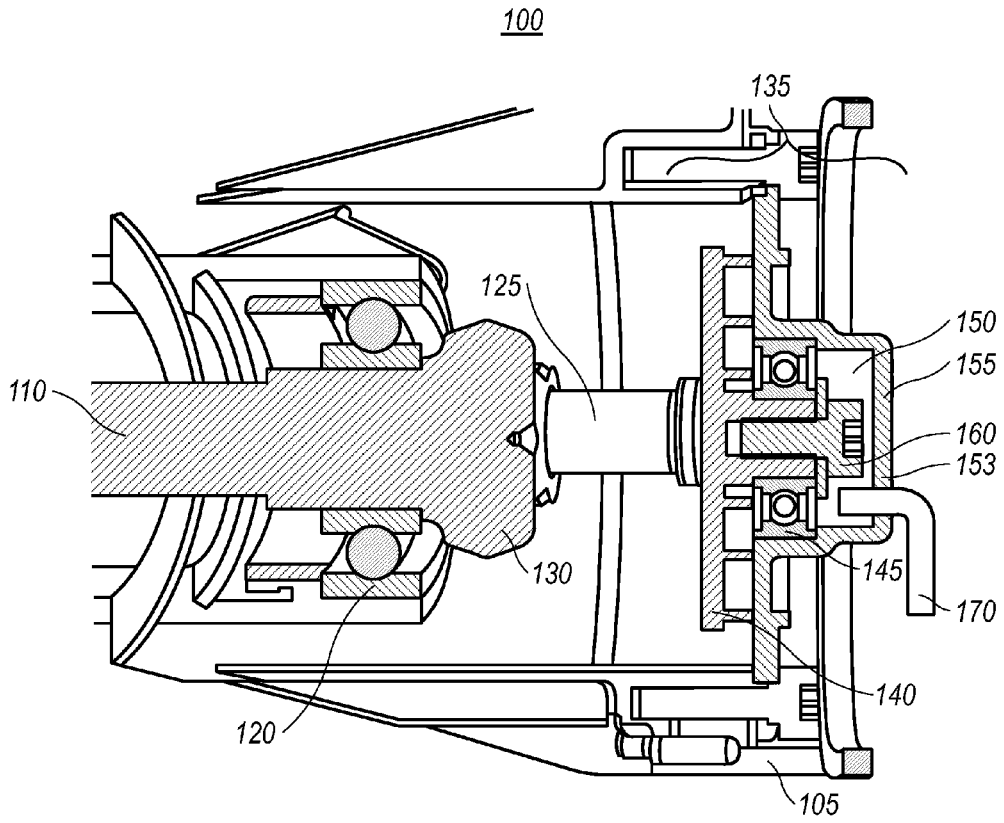
FIG. 2 is another cross-sectional of a four stroke engine having an example of a mechanical breather assembly in accordance with an exemplary embodiment.

The engine illustrated in FIGS. 1 and 2 can also include one or more of the following components: a mechanical breather system 135 that includes a rotating member 140 which can be coupled to the crankshaft 110, a breather bearing 145 which can be positioned adjacent to the rotating member 140, an air receiving chamber 150 which can be positioned on the breather bearing 145 and opposite from the rotating member 140, and a passage 165 in fluid communication with an interior of the air receiving chamber 150 and an exterior of the air receiving chamber 150. As illustrated in FIG. 1, the crankshaft 110 can be received in the crankcase 105 and can be supported by at least one bearing 120. The crankshaft 110 also can include a counterweight 130 on a first end 115 of the crankshaft 115.

A connecting member 125 can couple the crankshaft 110 to a rotating member 140. The connecting member 125 can couple the mechanical breather system 135 to the crankshaft 110. For example, the rotating member 140 can be driven directly or indirectly by the crankshaft 110. When the rotating member 140 is directly driven, the rotating member 140 can be affixed to the crankshaft 110 or driven by a connecting member 125 such as a crankpin. When the rotating member 140 is indirectly driven, another mechanism can couple the rotating member 140 to the crankshaft 110 so that different speeds or direction of motion may be achieved by the rotating member 140 as compared with the crankshaft 110. As illustrated, the connecting member 125 can be coupled at a first end to the counterweight 130 of the crankshaft 110. In FIG. 1, the rotating member 140 can be adapted to receive the second end of the connecting member 125 such that when the crankshaft 110 rotates, the connecting member 125 causes the rotating member 140 to rotate. While the connecting member 125 directly connects the crankshaft to the rotating member 140, other connecting members could be implemented whereby the angular acceleration and/or speed of the rotating member 140 can vary from the speed of the crankshaft 110. The rotating member 140 can include at least one inlet channel 310 (described in detail below in regards to FIG. 3). An inlet channel 310 as used herein refers to a pathway for fluid communication between the outer perimeter 305 of the rotating member 140 and an inner region of the rotating member 140. The inlet channel 310 can be formed by one or more vanes 311 as illustrated, further embodiments will be described below. The at least one inlet channel 310 of the rotating member 140 allows for oil to be spun outward from the rotating member 140 while air passes through a breather bearing 145 positioned adjacent thereto.

The breather bearing 145 can be positioned adjacent to the rotating member 140. As illustrated, the crankshaft 110 and counterweight 130 can be on the same side of breather bearing 145. The crankshaft 110 and the rotating member 140 can be adapted such that when the crankshaft 110 rotates the rotating member 140 rotates. In one embodiment, the breather bearing 145 can be mounted to an internal portion of the crankcase 105. In another embodiment, illustrated in FIGS. 1 and 2, the breather bearing 145 can also be coupled to a breather housing 155, which in turn can be coupled to the crankcase 105. In the illustrated embodiment, the coupling of the breather bearing 145 to the crankcase 105 or breather housing 155 can be a press-fit, welding or other suitable mounting configurations that fix the position of the breather bearing or breather housing during use of the engine 100. The breather bearing 145 can be adapted to allow air to pass from one side of the breather bearing 145 to the other side of the breather bearing 145. For example, with respect to the exemplary four-stroke engine 100 illustrated in FIGS. 1-2, air will pass from the left side of the breather bearing 145 to the right side of the breather bearing 145. An example of a breather bearing 145 adapted according to the present disclosure will be provided in detail below.

In the illustrated embodiments of FIGS. 1 and 2, a rotating member support member 160 positions the rotating member 140 relative to the breather housing 155 and the breather bearing 145. An air receiving chamber 150 can be positioned on the breather bearing 145 on a side of the breather bearing 145 opposite from the rotating member 140. A passage 165 can be provided through a wall 153 of the air receiving chamber 150 such that the passage 165 can be in fluid communication with an interior of the air receiving chamber 150 and an exterior of the air receiving chamber 150. As illustrated in FIG. 1, the coupling of the breather housing 155 and the breather bearing 145 defines the air receiving chamber 150. The top wall of the breather housing 155 that faces outwardly with respect to the rotating member 145 and the crankshaft 110 can provide the wall 153 for the passage 165 that can be in fluid communication with the interior of the air receiving chamber 150 and the exterior of the air receiving chamber 150. As seen in FIG. 1, the interior of the air receiving chamber 150 can be the area between the breather bearing 145 and the inner face of the top of the breather housing 155. The exterior of the air receiving chamber 150 can be the area on the outer face of the top of the breather housing 155 that is opposite to the inner face of the breather housing 155. In an alternative embodiment, the passage can include an exhaust stem 170, as illustrated in FIG. 2. While the air receiving chamber 150 as described above can be within the breather housing 155, other embodiments of the present disclosure can implement the inclusion of the air receiving chamber 150 within a portion of the crankcase 105 with or without the presence of a breather housing 155.

While the illustrated engine 100 in FIGS. 1 and 2 is a half-crank engine supported by one bearing 120, one of ordinary skill in the art will understand that the engine 100 can be a full-crank engine, as will be described later in this disclosure.

Figure 3:
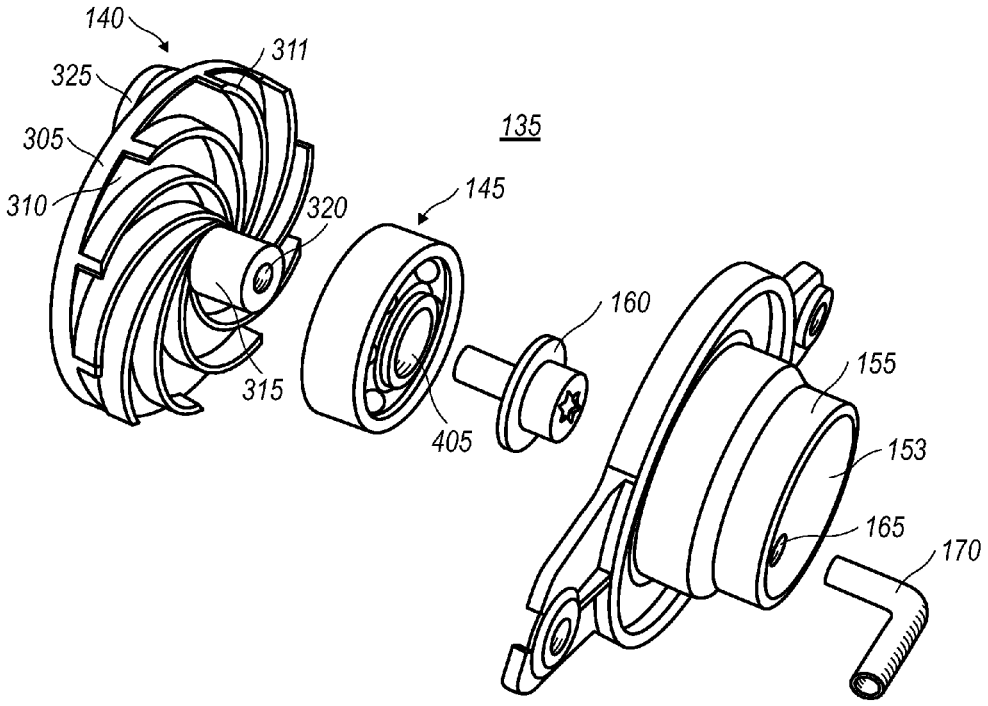
FIG. 3 is an exploded perspective view of an example of a mechanical breather assembly in accordance with an exemplary embodiment.

FIG. 3 is an exploded view of the mechanical breather system 135 for a four stroke engine. The rotating member 140 has at least one inlet channel 310 extending between an outer perimeter 305 of the rotating member 140 and an inner region of the rotating member 140. As illustrated in FIG. 3, the at least one inlet channel 310 can be curved between the outer perimeter 305 of the rotating member 140 and the center of the rotating member 140. However, the at least one inlet channel 310 can extend straight and radially from the center of the rotating member towards the perimeter 305 of the rotating member 140. Other configurations of the at least one inlet channel 310 can also be implemented. For example, the at least one inlet channel 310 can be curvilinear, or other non-linear shape. Additionally, while FIG. 3 illustrates a rotating member 140 having ten inlet channels 310, one of ordinary skill in the art will appreciate that the rotating member 140 can have two inlet channels, three inlet channels, seven inlet channels, thirteen inlet channels, or any number of inlet channels so long as the rotating member has at least one inlet channel 310. While the illustrated embodiment shows the at least one inlet channel 310 formed from a vane 311, one skilled in the art will appreciate that the at least one inlet channel 310 can be an aperture through the rotating member 140 or can be a groove formed in the surface of the rotating member 140. Additionally, as illustrated a plurality of vanes 311 are illustrated and thus a plurality of inlet channels 310. In the illustrated embodiment, ten vanes 311 are illustrated and are shaped with single cup shape along a single radius. In other embodiments, the vanes 311 can have multiple curvatures to encourage the flow of air in the at least one air inlet channel 310. In at least one embodiment the vanes 311 can encourage air to flow into more than one air inlet channel 310.

The rotating member 140 can include a socket 325 can be adapted to receive a second end of the connecting member 125. The socket 325 can be disposed on the face of the rotating member 140 that can be opposite to the side having the at least one inlet channel 310. In other embodiments, the connecting member 125 can be coupled to the rotating member 140 through other mounting mechanisms such as a screw, bolt, threaded engagement and other conventional fasteners or fastening means. In other embodiments, the connecting member 125 can be fixedly attached to the rotating member 140. The rotating member 140 can also include a protrusion 315 that protrudes from substantially the center of the rotating member 140. The protrusion 315 can be provided to receive the breather bearing 145. While the illustrated rotating member 140 in FIG. 3 is an impeller, one of ordinary skill in the art will appreciate that the rotating member 140 can be a rotor having inlet channels, a blower, a turbine, or any other rotating member that can have at least one inlet channel 310 in fluid communication between an outer perimeter 305 of the rotating member 140 and an inner region of the rotating member 140. As illustrated, the at least one inlet channel 310 can be formed from the vanes 311 which are integral part of the rotating member 140. In other embodiments, the vanes 311 can be constructed separately and affixed to the rotating member through welding or the like.

Figure 4:
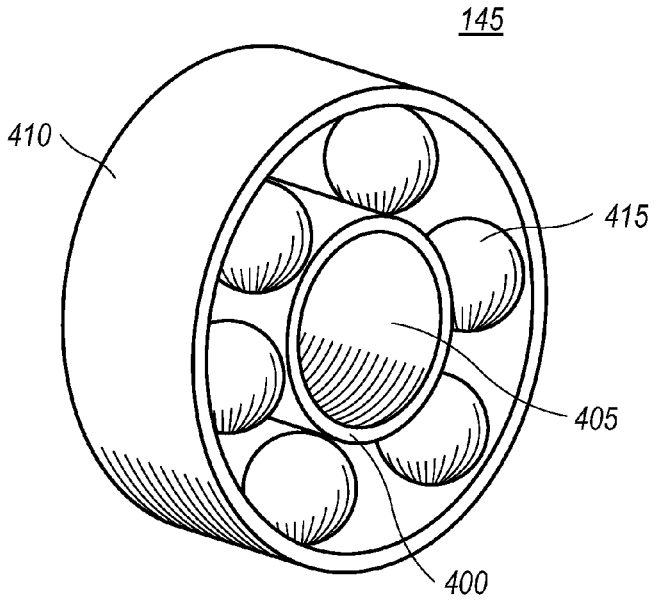
FIG. 4 is a perspective view of an example of a breather bearing in accordance with an exemplary embodiment.
Figure 5:
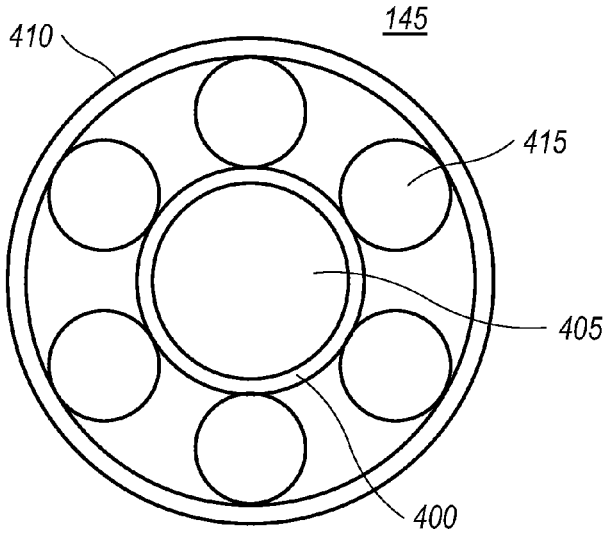
FIG. 5 is a front elevational view of the breather bearing illustrated in FIG. 4 in accordance with an exemplary embodiment.

As illustrated in FIGS. 4 and 5, the breather bearing 145 has an inner race 400 and an outer race 410. In at least one embodiment, including the illustrated embodiment, the breather bearing 145 can comprise at least one ball bearing. In other embodiments, other types of bearings that allow for air to pass therethough are considered within the scope of this disclosure. For example, the breather bearing 145 can comprise a needle bearing or a bushing between the inner race 400 and the outer race 410. The breather bearing 145 can be adapted to allow air to pass between the inner race 400 and the outer race 410. For example, the inner race 400 and the outer race 410 of the breather bearing 145 can form a space through which air can pass. In at least one embodiment, the breather bearing 145 can be the bearing that supports the crankshaft 110 in the crankcase 105.

FIG. 4 is a perspective view and FIG. 5 is a front view of the breather bearing 145 illustrating the inner race 400, the outer race 410, and the at least one ball bearing 415. The at least one ball bearing 415 can be free to move within the inner race 400 and the outer race 410 of the breather bearing 145. While the illustrated embodiments show six ball bearings 415 disposed between the inner race 400 and the outer race 410, one of ordinary skill in the art will appreciate that two ball bearings, three ball bearings, four ball bearings, or more can be disposed within the inner 400 and outer races 410 so long as the breather bearing 145 includes at least one ball bearing 415. In the embodiment illustrated in FIGS. 4-5, the ball bearings 415 can move within the area between the inner 400 and outer races 410 which can facilitate air passage between the ball bearings 415 and between the inner 400 and outer races 410. The breather bearing 145 as illustrated can be an unsealed bearing thereby facilitating the passage of air between the inner race 400 and the outer race 410.

In a half-crank engine, the crankshaft 110 does not extend through the crankcase 105. In at least one embodiment, as illustrated in FIG. 3, the breather bearing 145 includes an aperture 405 through the center of the breather bearing 145 that can be adapted to receive the protrusion 315 of the rotating member 140. The aperture 405 and protrusion 315 can be adapted to couple the breather bearing 145 with the rotating member 140 such that when the crankshaft 110 rotates the rotating member 140, the breather bearing 145 will also rotate. The cooperation of the aperture 405 and protrusion 315 add further stability to rotating member 140 as it rotates. Furthermore, the protrusion 315 can also include rotating member support aperture 320 which can be adapted to receive the rotating member support member 160. The rotating member support member 160 can position the rotating member 140 relative to the breather housing 155 and the breather bearing 145. The rotating member support member 160 can also be rotatably coupled to the breather housing 155. The breather housing 155 can be adapted to receive the breather bearing 145 and to rotatably couple the rotating member 140 to the crankcase 105. The breather housing 155 includes an air receiving chamber aperture 165 through a top wall of the breather housing 155. The air receiving chamber aperture 165 can be adapted to receive an exhaust stem 170, as illustrated in FIG. 3. The exhaust stem 170 provides the passage in fluid communication between the interior of the air receiving chamber 150 and the exterior of the air receiving chamber 150. While the embodiment illustrated in FIG. 3 includes an exhaust stem 170 to be inserted into the air receiving chamber aperture 165, one of ordinary skill in the art will appreciate that the air receiving chamber aperture 165 can provide the passage in fluid communication with the interior of the air receiving chamber 150 and the exterior of the air receiving chamber 150 and can also provide the passage of air from within the air receiving chamber 150 to the exterior of the crankcase 105. In an alternative embodiment, the exhaust stem 170 can be a hose, such as a rubber hose. In other implementations, the exhaust stem 170 can be a channel, a tube, or other component that allows for the passage of air from within the air receiving chamber 150 to the exterior of the crankcase 105.

Figure 6:
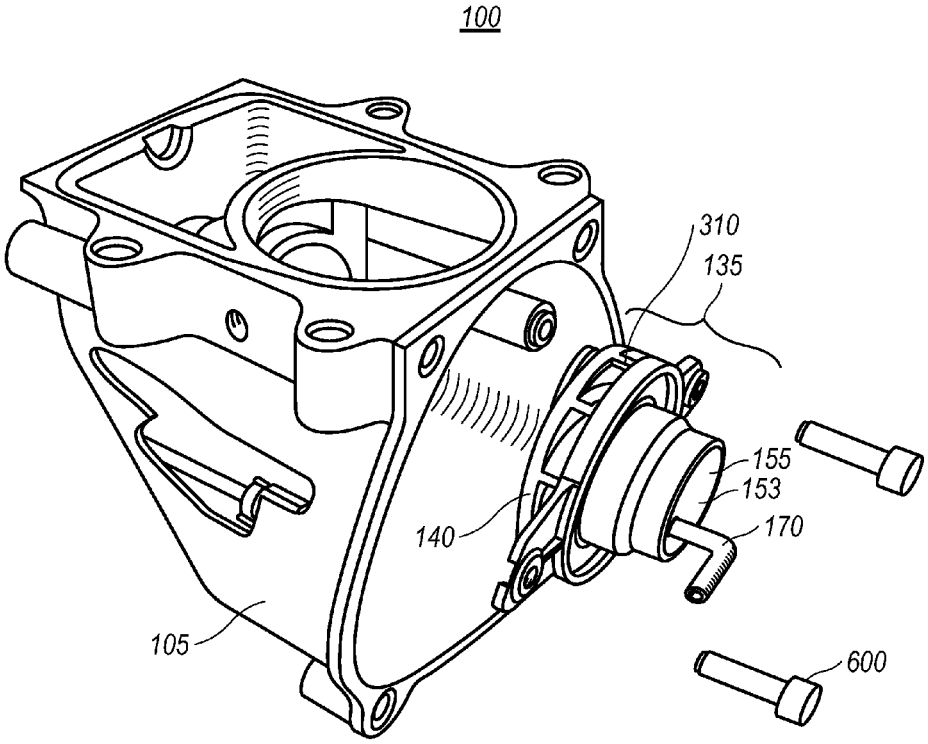
FIG. 6 is an exploded perspective view of an exemplarily four stroke engine having an example of a mechanical breather assembly in accordance with an exemplary embodiment excluding the crankshaft.

FIG. 6 is an exploded view of an assembled mechanical breather system 135 in accordance with the present disclosure with respect to the engine crankcase 105. In FIG. 6, the assembled mechanical breather system 135 is illustrated without the associated crankshaft of the four-stroke engine 100. In an assembled configuration, the breather bearing 145 can be received within an interior of the breather housing 155 such that a surface of the breather housing 155 can be adjacent to the at least one inlet channel 310 of the rotating member 140. Fasteners 600 can secure the breather housing 155 to the crankcase 105, which together with the connecting member (not shown) thereby secures the mechanical breather system 135 in place during operation of the four stroke engine 100. While the fasteners 600 as illustrated are bolts, other types of fasteners can be implemented to releasably secure the breather housing 155 to the crankcase 105. In yet other embodiments, the fasteners 600 can be non-releasable fasteners that are for permanently affixing the breather housing 155 to the crankcase 105. In the assembled configuration, the exhaust stem 170 protrudes from the top of the breather housing 155 to expel the air and excess pressure from inside the crankcase 105.

Figure 7:
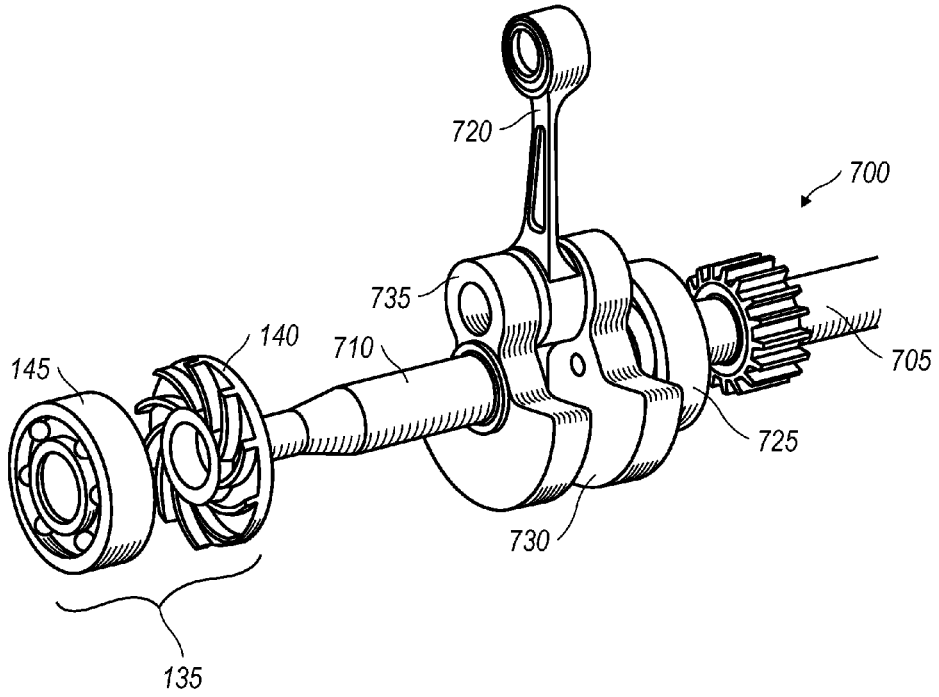
FIG. 7 is an exploded view of an example of a mechanical breather system with a crankshaft of a full-crank engine in accordance with an exemplary embodiment.
Figure 8:
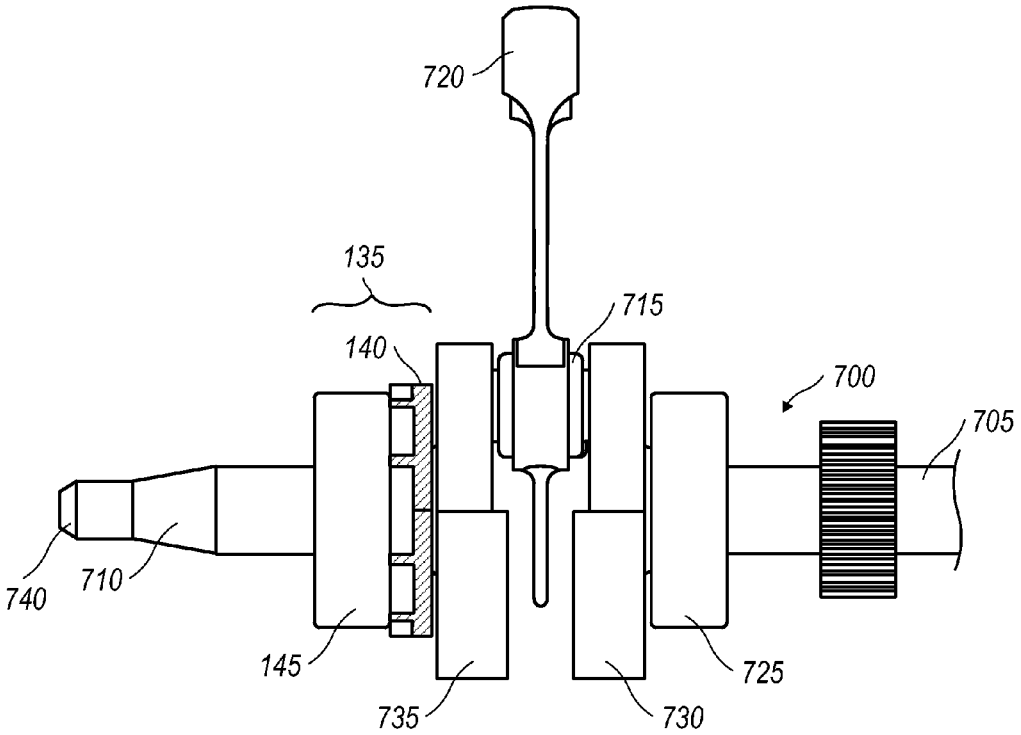
FIG. 8 is an exemplary side elevational view of the mechanical breather system illustrated in FIG. 7.

In an alternative embodiment, the mechanical breather system 135 can be adapted as illustrated in FIGS. 7 and 8. FIG. 7 is a perspective view, and FIG. 8 is a side view of the mechanical breather system 135 in accordance with the present disclosure for the crankshaft 110 of a full-crank engine. The embodiment illustrated in FIGS. 7 and 8 is shown without the associated crankcase of the full-crank engine. The crankshaft 700 has a first portion 705 and a second portion 710 coupled together by a crankpin 715. The crankshaft 700 can be supported by at least two bearings 725, 145. A connecting rod 720 can be coupled to the crankpin 715 such that when a piston (not shown) associated with the connecting rod 720 reciprocates within a cylinder (not shown) of the full-crank engine, the crankshaft 700 will rotate within the crankcase. A first counterweight 730 can be coupled to the first portion 705 of the crankshaft 700 and can be positioned adjacent to the crankpin 715. A bearing 725 can also be coupled to the first portion 705 of the crankshaft 700 such that the bearing 725 can be adjacent to the first counterweight 730 on the side opposite to the crankpin 715. The bearing 725 can be coupled to the crankcase such that the crankshaft 700 can be supported for rotation within the crankcase. A second counterweight 735 can be coupled to the second portion 710 of the crankshaft 700 and can be positioned the crankpin 715. In FIGS. 7 and 8, the first counterweight 730 and the second counterweight 735 are positioned on opposite ends of the crankpin 715. The mechanical breather system 135 can be mounted to the second portion 705 of the crankshaft 700 adjacent to the second counterweight 735 on the side opposite to the crankpin 715. The rotating member 140 of the mechanical breather system 135 can be positioned adjacent to the second counterweight 735. As illustrated in FIG. 8, the rotating member 140 can be coupled to the crankshaft 700. In the illustrated embodiment, the rotating member 140 rotates in direct correspondence to rotation of the crankshaft 700. In other embodiments, the rotating member 140 can be adapted to rotate at a different rate as compared to the crankshaft 700. The breather bearing 145 can be positioned adjacent to the rotating member 140 on the side having the at least one inlet channel 310 as described above. In the illustrated embodiment of FIGS. 7 and 8, the breather bearing 145 can be one of the at least two bearings 725, 145 supporting the crankshaft 700 to the crankcase. The at least two bearings 725, 145 can be adapted to allow for fluid communication between the inner and outer races of the breather bearing 145. While the illustrated embodiment shows a breather bearing 145 and a bearing 725, one of ordinary skill in the art will appreciate that a third bearing can be used to support the crankshaft 700 to the crankcase in addition to the breather bearing 145. The second portion 710 of the crankshaft 700 can include a protruding end 740 which passes through the air receiving chamber 150 of the mechanical breather system 135. In other respects the mechanical breather 135 can be adapted as described above.

Figure 9:
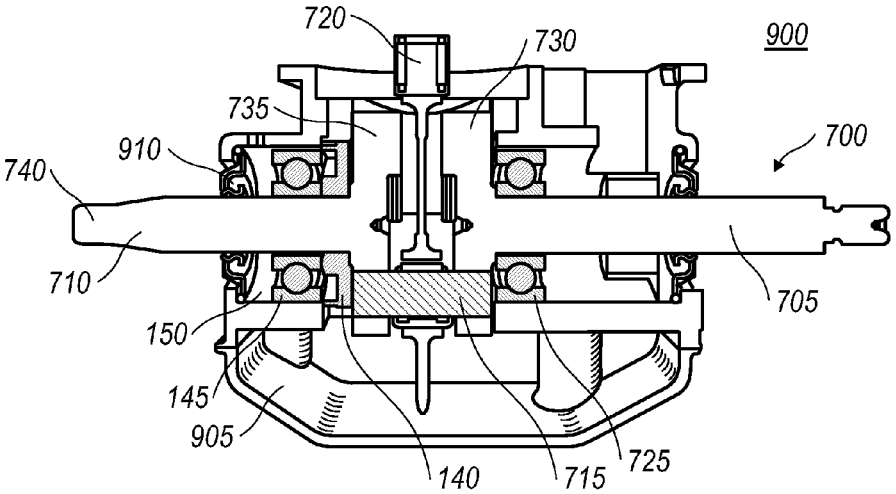
FIG. 9 is a cross-sectional view of a four stroke engine having an example of a mechanical breather system in a full-crank engine in accordance with the present disclosure.

FIG. 9 is a side cross-sectional view of the mechanical breather system 135 illustrated in FIG. 8 as it is assembled in a full-crank engine 900. The full-crank engine 900 can include a seal 910 for sealing the crankcase 905 and the protruding end 740 of the second portion 710 of the crankshaft 700. As illustrated, the seal 910 and the crankcase 905 can provide the air receiving chamber 150 positioned on the breather bearing 145 and opposite from the at least one inlet channel 310 of the rotating member 140. For example, the seal 910 and the crankcase 905 can form the wall 153 of the air receiving chamber 150 on which the passage can be disposed. The passage can be then in fluid communication with the interior and the exterior of the air receiving chamber. In the illustrated example of FIG. 9, the passage can be space between the protruding end 740 of the crankshaft 700 and the seal of the crankcase 905.

Figure 10:
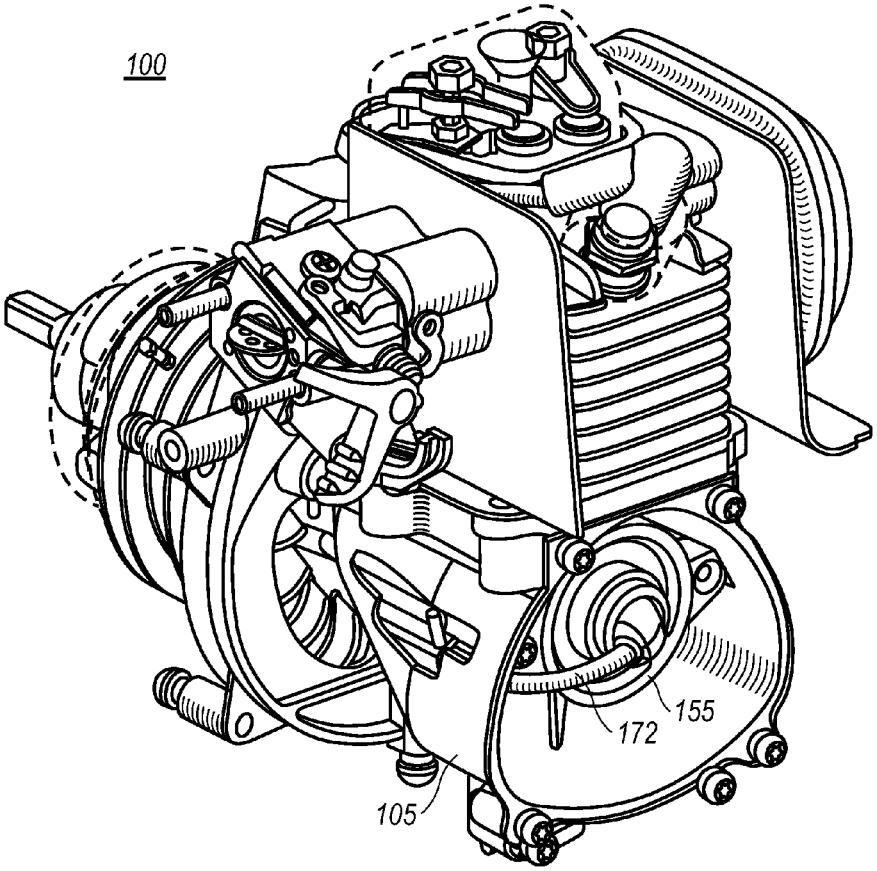
FIG. 10 is a perspective view of a four stroke engine having an example of a mechanical breather system in an assembled configuration in accordance with the present disclosure.
Figure 11:
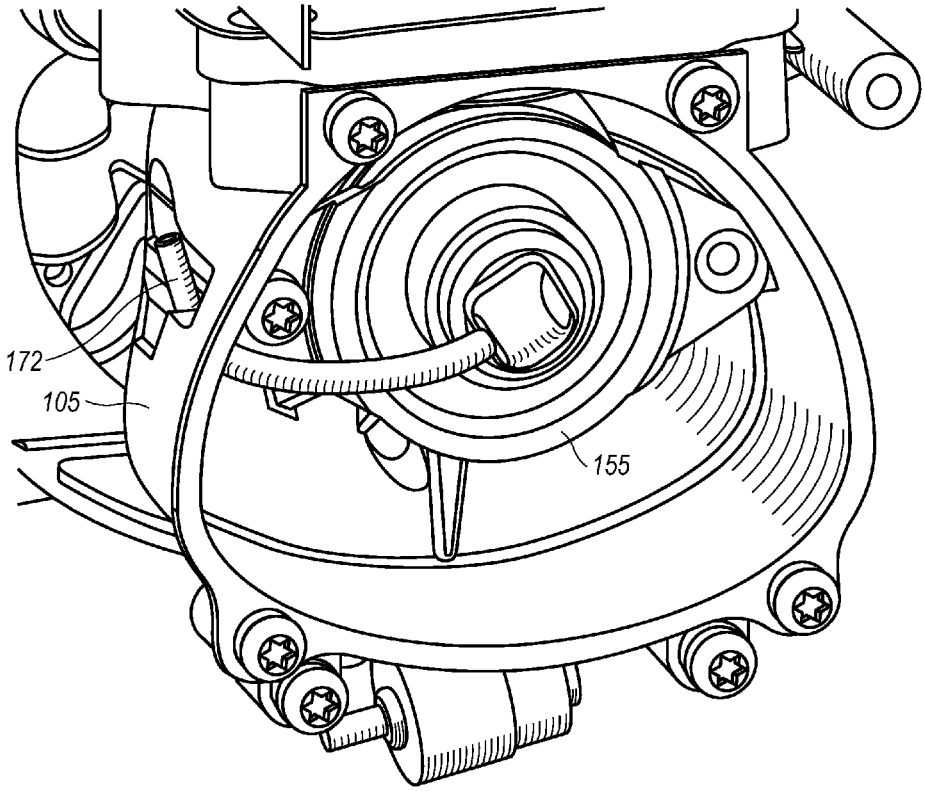
FIG. 11 is an exemplary partial view of the four stroke engine illustrated in FIG. 10.

FIG. 10 is a perspective view of an exemplary four-stroke engine 100 assembled with a mechanical breather system 135 in accordance with an exemplary embodiment described herein. FIG. 11 is a partial view of the four-stroke engine 100 illustrated in FIG. 10. Specifically, FIG. 11 is a front view of the breather housing 155 of the crankcase, which can be coupled to the mechanical breather system 135. In FIG. 11, the exhaust stem 170 extends from the interior of the air receiving chamber 150 and passes through the top wall of the breather housing 155 towards the exterior of the air receiving chamber to expel the air and excess pressure of the crankcase 105. Additionally, the exhaust stem 170 connects to a hose 172 which further carries the air towards an air intake portion of the engine 100. While a hose 172 is illustrated, other coupling mechanisms can be implemented, for example, tubes, channels and other coupling mechanism to allow for the further transport of air away from the air receiving chamber 150.

Figure 12:
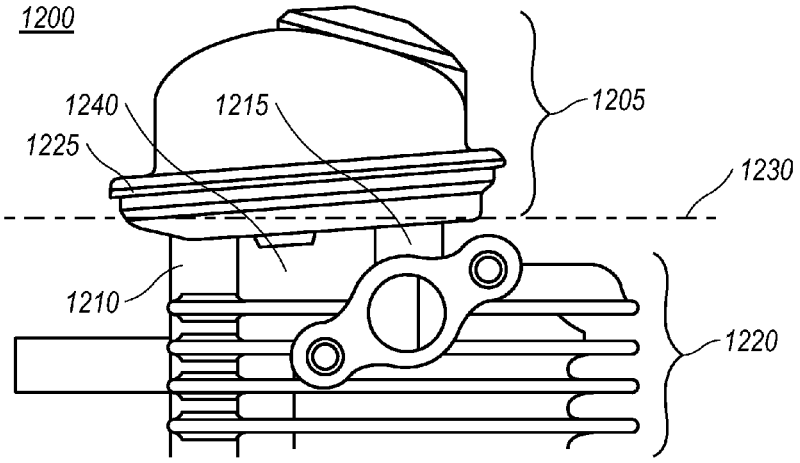
FIG. 12 is side view of an example of a rocker box assembly in accordance with the present disclosure.
Figure 13:
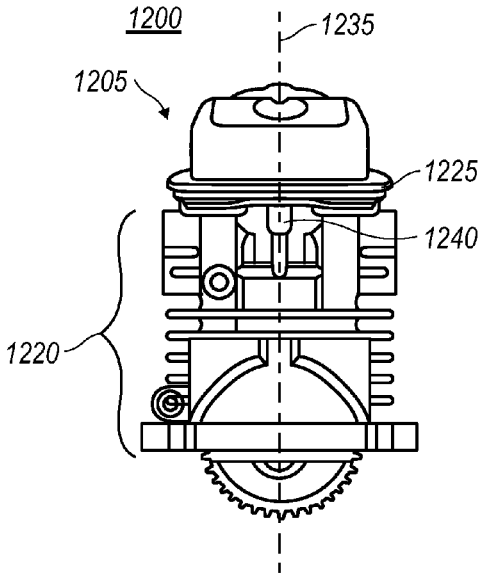
FIG. 13 is a front view of a four stroke engine having the exemplary rocker box assembly illustrated in FIG. 12.
Figure 14:
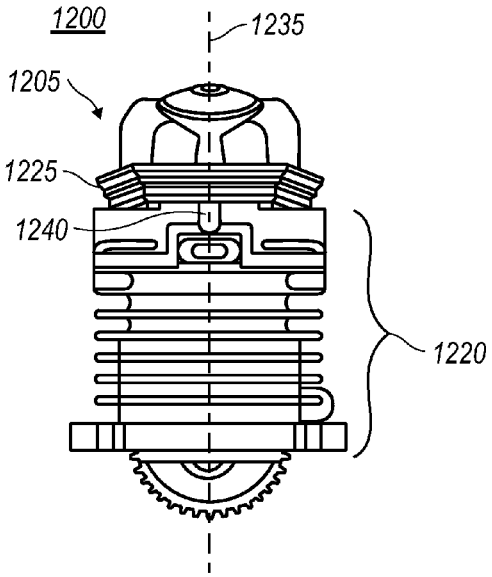
FIG. 14 is a rear view of the four stroke engine having an example of a rocker box assembly illustrated in FIG. 13.
Figure 15:
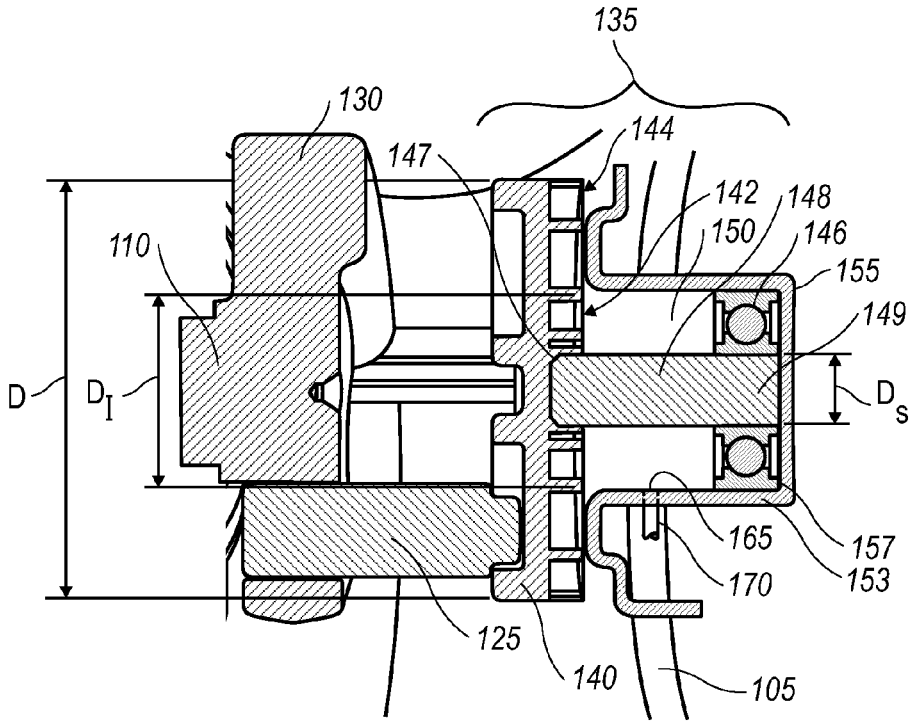
FIG. 15 is a cross-sectional view of a four-stroke engine having another example mechanical breather assembly in accordance with the present disclosure.

FIG. 12 is a side perspective view of an exemplary embodiment of an engine 1200 including a rocker box 1205 adapted according to the teachings of this disclosure. FIG. 13 is a front perspective view and FIG. 14 is a rear perspective view of the engine 1200 including a rocker box 1205 as illustrated in FIG. 12. A rocker box assembly 1205 can be coupled to the four stroke engine 1200 via a push rod shaft 1210 and a valve stem shaft 1215 above the engine block 1220 of the four stroke engine 1200. The rocker box assembly 1205 includes a bottom surface 1225 to which both the push rod shaft 1210 and the valve stem shaft 1215 are coupled. The bottom surface 1225 can be angled towards the push rod shaft 1210. For example, the bottom surface 1225 can decline towards the push rod shaft 1210 along the longitudinal axis 1230 of the bottom surface 1225. In an alternative embodiment, the bottom surface 1225 can decline towards the push rod shaft 1210 along the lateral axis 1235 of the bottom surface 1225. In another alternative embodiment, the bottom surface 1225 can decline towards the push rod shaft 1210 along both the lateral axis 1235 and the longitudinal axis 1230 of the bottom surface 1225. In the particular embodiment illustrated in FIG. 12, the inclination of the bottom surface 1225 can be tilted at a 15-degree angle from the push rod shaft 1210 to the valve stem shaft 1215. In alternative embodiments, the bottom surface 1225 can be inclined at a 17-degree angle, a 25-degree angle, a 30-degree angle, or any other angle not less than 15-degrees.

As seen in FIGS. 12-14, the inclination of the rocker box 1205 forms a window 1240 with the adjacent engine block 1220. The shape of the window 1240 corresponds to the inclination of the bottom surface 1225 of the rocker box assembly 1205. The window 1240 permits a larger volume of cooling air to flow across any intervening valves and ports between the rocker box assembly 1205 and the engine block 1220. Such cooling air can cool the valves and ports thereby enhancing the efficiency of the engine 1200. For example, as shown in FIGS. 12-13, the window 1240 has a trapezoidal shape. Because of the trapezoidal shape, air flows through the window 1240 similar to air flow through a nozzle. Because of the inclination of the bottom surface 1225 of the rocker box assembly 1205, the air flowing beneath the rocker box assembly 1205 can be distributed to cool more surface areas of the valves and ports between the rocker box assembly 1205 and the engine block 1220. Although FIGS. 12-13 illustrate a window 1240 having a trapezoidal shape, one of ordinary skill in the art will appreciate that the window 1240 can have any other shape, such as a window having a concave top portion, a window having a convex top portion, an ovular window, or the like so long as the shape corresponds with the inclination of the bottom surface 1225 of the rocker box assembly 1220.

A method of draining excess oil within a four stroke engine will be described in relation to the rocker box assembly 1205 illustrated in FIGS. 12-14. While the following method can be described with respect to the particular embodiment illustrated in FIGS. 12-14, one of ordinary skill in the art will appreciate that the method can be applied to any embodiment including any of the components described in this disclosure. During operation of the four stroke engine 1200, pressure changes within the crankcase can draw oil up through the push rod shaft 1210 in to the rocker box assembly 1205 which can cause buildup of unwanted oil in the rocker box assembly 1205. However, in the illustrated rocker box assembly 1205, the bottom surface 1225 of the rocker box declines toward the push rod shaft 1210. As oil collects within the rocker box assembly 1205, the oil can drain down the bottom surface 1225 of the rocker box assembly 1205 towards the push rod shaft 1210. The oil can then drain down the push rod shaft 1210 and back into the crankcase. The oil drainage can lubricate the connecting rod and can keep excess oil from pooling in the top of the rocker box assembly 1205.

Another exemplary embodiment of a mechanical breather assembly according to the present disclosure is presented in FIGS. 15-19. While the mechanical breather assembly 135 as illustrated in FIGS. 15-19 is implemented on both a half-crank engine, the mechanical breather assembly 135 can be implemented on a full-crank engine. As both the half-crank and full-crank engines have been illustrated above, FIG. 15 is a cross-section view of the breather assembly 135 and its coupling to the crankshaft 110. The rotating member 140 can be coupled to the crankshaft 110. A connecting member 125 directly connects the crankshaft 110 to the rotating member 140. The connecting member 125 is shown as being coupled to the counterweight 130 of the crankshaft. Additionally, the rotating member 140 can be mounted on the crankshaft 110. For example, when the engine 100 can be a full-crank engine, the rotating member 140 can have a through hole and a key receiving portion so as to couple the rotating member 140 to the crankshaft 110. While the illustrated embodiment uses a connecting member 125, the rotating member 140 can be coupled directly or indirectly to the crankshaft 110. For example, other connecting members could be implemented whereby the angular acceleration and/or speed of the rotating member 140 can vary from the speed of the crankshaft 110.

The rotating member 140 can be adapted as described above. Namely, the rotating member 140 can be adapted so as to sling oil outward while allowing air to pass to the inner portion 142 of the rotating member. The rotating member 140 can include at least one inlet channel 310 (as described in regards to FIGS. 3 and 16). The inlet channel 310 as used herein can refer to a pathway for fluid communication between the outer perimeter 305 of the rotating member and an inner region 142 of the rotating member 140. The inlet channel 310 can be formed by one or more vanes 311 as illustrated. Further embodiments as described herein can also be implemented.

A breather housing 155 can be coupled to engine 100 so that it is adjacent to the rotating member 140. The breather housing 155 has an air receiving chamber 150 formed therein. The air receiving chamber 150 can be adapted to receive air from the rotating member 140. As described above, as the rotating member 140 rotates it spins oil outward and allows the blow-by air to pass to an inner region 142 of the rotating member 140. The rotating member 140 can be adapted to allow fluid communication of air to the air receiving chamber 150. For example, as illustrated, when the rotating member 140 has at least one inlet channel 310, the inner portion of the at least one inlet channel 310, corresponding to the inner portion 142 of the rotating member 140, is in fluid communication with the air receiving chamber 150. The inner portion 142 of the rotating member 140 can be adapted to allow air to pass from the at least one inlet channel 310 to the air receiving chamber 150. In the illustrated embodiments, the at least one inlet channel 310 can be open so as to allow the air to flow from the at least one inlet channel 310 to the air receiving chamber 150. In other embodiments, a plate or cover can be installed on the rotating member 140 to restrict to control the air flow to the air receiving chamber 150. For example, the plate can limit where along the at least one inlet channel 310 air is allowed to flow into the air receiving chamber 150.

While the description provided below is in relation to cylindrical areas and cross-sections, the rotating member 140, air receiving chamber 150 and other components can have non-cylindrical shapes. Additionally, other ratios and relative sizes of the components can be implemented as well. In the illustrated embodiment, the rotating member has a diameter (D) that is larger than the diameter ($D_I$) of the air receiving chamber 150. The relative ratio of the diameter (D) to diameter ($D_I$) of the air receiving chamber 150 allows for some separation of the oil from the air via the at least one channel of the rotating member. When the at least one channel 310 is open to the air receiving chamber 150, the relative sizes of the rotating member 140 and air receiving chamber 150 allow for the required separation of oil from air so that little or no oil is passed into the air receiving chamber 150. The relative ratio of the diameter (D) as compared with diameter ($D_I$) of the air receiving chamber can also dependent upon the diameter (Ds) of the shaft 148 so that air flow into the air chamber 150 is sufficient. For example the ratio of diameter (D) of the rotating member 150 to that the diameter ($D_I$) of the air receiving chamber 150 can be two to one, three to one, three to two, or any other ratio. The ratio can depend upon the oil used and the size of the engine 100. Furthermore, the ratio can also depend upon the speed that the engine is designed to operate under normal conditions. While the above description is provided in relation to the diameters of the components, similar ratios of radiuses can also be made.

When the engine is a half-crank like the one illustrated, the rotating member 140 can be coupled to a to a rotating member shaft 148. The rotating member shaft 148 can be coupled at a first end 147 to the rotating member 140. The second end 149 of the rotating member shaft 148 can be coupled to a bearing 146. The rotating member shaft 148 can be removably coupled at both the first end 147 and the second end 149. The rotating member shaft 148 provides for stabilization when the rotating member can be turned by a half-crank engine. In other embodiments, the rotating member shaft can be removed if the rotating member can be substantially supported in relation to the crankshaft such with a full-crank engine and the bearing 146 can provide support for the crankshaft (not shown).

The bearing 146 can be coupled to the bearing housing 155. As shown, the bearing can be located on the opposite side of the air receiving chamber 150 from the rotating member 140. The bearing 146 can be coupled to adjacent to an outside wall 157 of the breather housing 155. The outside wall 157 can be substantially opposite and substantially parallel to the rotating member 140. In at least one embodiment, the outside wall 157 refers to interior portion of the breather housing. Additionally, when there are double walls for the breather housing 155, the term adjacent refers to the location of the bearing 146 nearest to the wall forming the interior of the breather housing 155. In yet another embodiment, the bearing 146 can be located between two walls. The rotating member shaft 148 traverses the air receiving chamber 150.

The air from the rotating member 140 enters the air receiving member and can be expelled via passage 165. The passage provides for coupling of an exhaust stem 170 that takes the air outside of the air receiving chamber.

Figure 16:
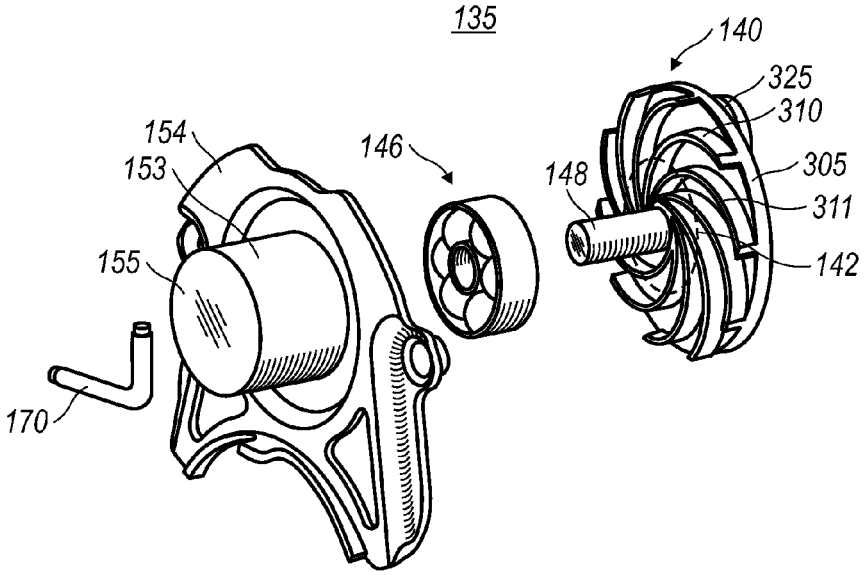
FIG. 16 is an exploded view of the mechanical breather assembly illustrated in FIG. 15.

FIG. 16 illustrates an exploded perspective view of the mechanical breather system 135. The mechanical breather assembly includes the rotating member 140, rotating shaft 148, bearing 146, breather housing 155, and an exhaust stem 170. The rotating member 140 as illustrated includes at least one inlet channel 310 extending between an outer perimeter 305 of the rotating member 140 and an inner region of the rotating member 140. As illustrated in FIG. 16, the at least one inlet channel 310 can be curved between the outer perimeter 305 of the rotating member 140 and the center of the rotating member 140. However, the at least one inlet channel 310 can extend straight and radially from the center of the rotating member towards the perimeter 305 of the rotating member 140. Additionally, while FIG. 16 illustrates a rotating member 140 having ten inlet channels 310, the rotating member 140 can have two inlet channels, three inlet channels, seven inlet channels, thirteen inlet channels, or any number of inlet channels so long as the rotating member has at least one inlet channel 310. While the illustrated embodiment shows the at least one inlet channel 310 formed from a vane 311, the at least one inlet channel 310 can be an aperture through the rotating member 140 or can be a groove formed in the surface of the rotating member 140. Additionally, as illustrated a plurality of vanes 311 are illustrated and thus a plurality of inlet channels 310. In the illustrated embodiment, ten vanes 311 are illustrated and are shaped with single cup shape along a single radius. In other embodiments, the vanes 311 can have multiple curvatures to encourage the flow of air in the at least one air inlet channel 310. Additionally, the rotating member 140 can include a socket 325 can be adapted to receive a second end 149 of the connecting member 125. The socket 325 can be disposed on the face of the rotating member 140 that is opposite to the side having the at least one inlet channel 310. In other embodiments, the connecting member 125 can be coupled to the rotating member 140 through other mounting mechanisms such as a screw, bolt, threaded engagement and the like. In other embodiments, the connecting member 125 can be fixedly attached to the rotating member 140.

The bearing illustrated in FIG. 16 is an unsealed bearing having an inner race and an outer race. The unsealed configuration allows for passage of air between the inner race and outer race. In other embodiments, a sealed bearing can be implemented. When the sealed bearing is implemented it can also include a lubricant within the sealed bearing.

The breathing housing 155 can be formed to an integral engine cover 154. When the breather housing is formed as part of the engine cover 154, the engine cover can be coupled to the engine using removable fasteners such as bolts, screws, and pins. Additionally, a seal can be included that prevents air or other fluids from escaping the engine cavity.

Additionally, the inner portion 142 of the rotating member 140 is illustrated in FIG. 16. As illustrated, the inner portion 142 is shown in dashed lines. As discussed above, the inner portion 142 is the portion of the rotating member 140 that can be in fluid communication with the air receiving chamber 150. The channels 310 of the rotating member can be enclosed until they reach the inner portion 142 of the rotating member 140. In other embodiments, an additional member can be included that prevents the flow of air from the rotating member 140 to the air chamber 150 until it reaches the inner portion 142 of the rotating member 140. For example, the additional member can be a plate with apertures.

Figure 17:
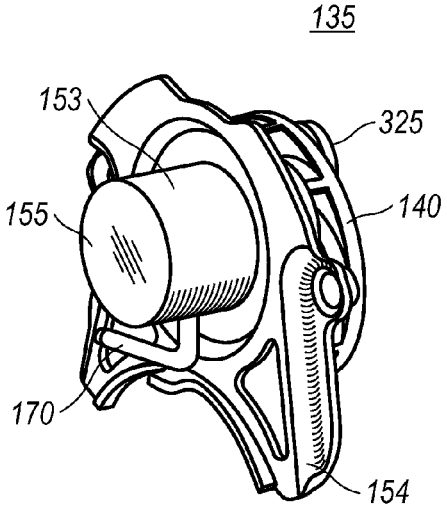
FIG. 17 is a perspective view of the mechanical breather assembly illustrated in FIG. 16.

FIG. 17 illustrates the assembled perspective view of the mechanical breather assembly of FIG. 16. As illustrated the bearing 146 has been coupled within the breather housing 155 and the rotating member shaft 148 has been coupled to the bearing 146. The exhaust stem 170 has been coupled to the breather housing 155 to provide for passage of air from within the bearing housing to an air intake port (not illustrated).

Figure 18:
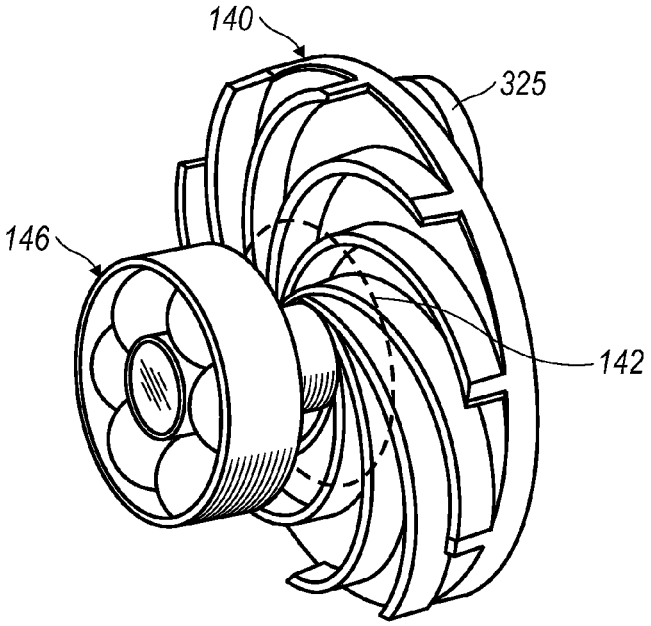
FIG. 18 is an exemplary perspective view of the rotating member, rotating member shaft and bearing illustrated in FIG. 15.

FIG. 18 illustrates an exploded view of the rotating member 140 and bearing 146. As illustrated the shaft 148 can be coupled to an inner race of the bearing 146. As mentioned above, the bearing 146 can be an unsealed bearing. In other embodiments, the bearing can be a sealed bearing.

Figure 19:
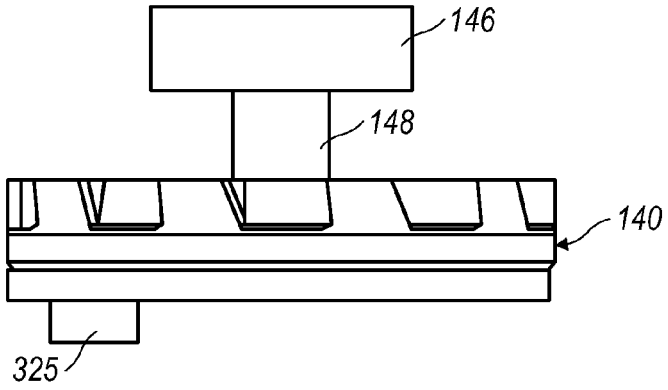
FIG. 19 is an exemplary plan view of the rotating member, rotating member shaft and bearing illustrated in FIG. 15.

FIG. 19 illustrates a plan view of bearing 146, rotating member shaft 148 and rotating member 140. As seen, the rotating member shaft 148 extends perpendicularly away from the rotating member 140.

Another example of a mechanical breather 135 according to the present disclosure is illustrated in FIGS. 20-23.

Figure 20:
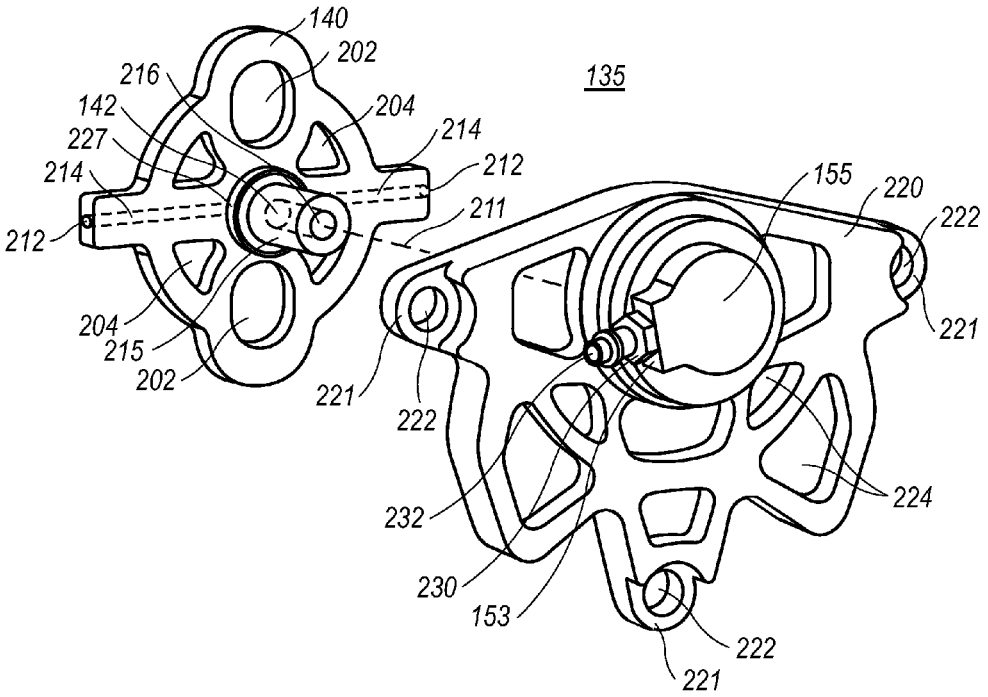
FIG. 20 is an exemplary perspective exploded view yet another example of a mechanical breather assembly in accordance with the present disclosure.

As illustrated in FIG. 20, the mechanical breather 135 like the above described examples includes a rotating member 140. The rotating member 140 can be adapted to be coupled to and driven by a crankshaft 110 of an engine (not shown). The rotating member 140 can have at least one inlet channel 214 extending between an outer perimeter of the rotating member 214 and inner region of the rotating member 214. The mechanical breather 135 can further include a breather housing 155 having an air receiving chamber (not shown) formed therein. The air receiving chamber can be positioned adjacent to a portion of the at least one inlet channel 214 of the rotating member 140.

In the above described examples, the at least one inlet channel had an open side surface to allow the air to flow from the inlet channel directly into the air receiving chamber 150 formed in the breather housing 155 or through a breather bearing into the air receiving chamber 150. In this example, the at least one inlet channel 214 can be formed within the rotating member such that each of the at least one inlet channels 214 only has a single inlet 212 and a single outlet 227. As illustrated, the single inlet 212 can be located on the perimeter of the rotating member 135. The single inlet 212 can be in the shape of a circle. In other embodiments, the single inlet 212 can have other shapes such as square, oval, or another symmetrical shape. When the shape is symmetrical it provides for better balancing of the rotating member 140. When the shape is a non-symmetrical shape, the rotating member 140 can be adjusted so as to promote balancing of the rotating member 140. As illustrated there are two inlets 212 each corresponding to a respective inlet channel 214. The respective inlet channels 214 also each have a single outlet 227. In other implementations, the inlet channels 214 can have more than one inlet 212. For example, an inlet channel 214 can have two inlets 212 or any other number of inlets 212. The inlets can join with a single inlet channel 214. In other embodiments, there can be more than one outlet 227 for a single inlet channel 214. Additionally, in at least one embodiment the inlet channel 214 can have a plurality of inlets 212 and a plurality of outlets 227.

As illustrated, there are two inlet channels 214 formed in the rotating member 140. The two inlet channels 214 are located are located symmetrically about the axis of rotation of the rotating member 140. This promotes balancing of the rotating member. The air that enters through the openings 212 of the inlet channels 214 can be expelled through an exit 216 formed in the rotating member shaft 215. More details regarding the flow of air through the rotating member 140 will be discussed below with respect to FIG. 23. The rotating member shaft 215 allows for the rotating member 140 to rotate about an axis 211 of rotation. The rotating member shaft 215 can be adapted to be coupled to a bearing. While the phrase coupled to a bearing has been used, it is understood that the coupling of the bearing can be releasable coupling, keyed contact with the rotating member shaft 215, substantial contact of the rotating member shaft 215 with the bearing, or other engagement with the bearing such that the bearing allows the rotating member shaft 215 to rotate with little resistance.

As illustrated, the rotating member has a plurality of balancing formed voids 204. These balancing formed voids 204 promote balancing of the rotating member 140. In the rotating member 140 as illustrated there are four balancing formed voids 204 that are arranged symmetrically about the axis of rotation of the rotating member 140. The symmetrical orientation of the balancing formed voids 204 allows reduced balancing of the rotating ember 140. In some circumstances, additionally balancing may be needed. When additional balancing is required, the adjustments to the rotating member 140 can be small due to the pre-balanced configuration. While four balancing formed voids 204 are illustrated, other configurations are possible.

The rotating member 140 can formed such that one or more receiving holes 202 are formed through the rotating member 140. The receiving holes 202 can be adapted to couple a connecting member of the four-stroke engine to the rotating member 140. Other embodiments of the coupling between the connecting member and receiving holes will be described below in regards to FIG. 21.

While the illustrated embodiment includes two inlet channels 214 and two receiving holes 202, other numbers of inlet channels 214 and receiving holes 202 can be implemented. For example, the present technology can be implemented with three inlet channels 214 and three receiving holes 202. In yet another embodiment, four inlet channels 214 can be implemented with four receiving holes 202. Other symmetrical configurations can be implemented. The symmetrical configuration of the inlet channels 214 and receiving holes 202 promotes balancing of the rotating member 140. In yet other embodiments, non-symmetrical configurations of inlet channels 214 and receiving holes 202 can be implemented. For example, a single receiving hole 202 can be implemented with three inlet channels.

The rotating member 140 can be adapted to be coupled to the mechanical breather retainer 220. The mechanical breather retainer 220 can be adapted to hold the rotating member 140 in an engaged configuration relative to the crankshaft of the engine. As illustrated, the breather housing 155 can be coupled to the mechanical breather retainer 220. The breather housing 155 can be integrally formed with the mechanical breather retainer 220 or can be bonded, fastened, or coupled to the mechanical breather retainer via welding, press fitting, or a molding process in the situation were the breather housing 155 and/or the mechanical breather retainer 220 is made of a moldable material. The breather housing 155 has a vent fitting 230 coupled thereto. The vent fitting 230 can have a thread connection for engaging with a corresponding threaded portion of the breather housing 155. The vent fitting 230 can have an outlet portion 232. The outlet portion 232 of the vent fitting 230 can be a barbed fitting, such as the one illustrated. In other configurations, the outlet portion 232 can have another type of connection, for example a threaded connection, a tapered connection, or other releasable connection.

The mechanical breather retainer 220 can have mounting portions 221 to secure the mechanical breather retainer 220 to a portion of the engine. The mounting portions 221 can have through holes 222 formed therein to accommodate a fastener. Additionally, the mechanical breather retainer 220 can have portions removed therefrom to lighten the mechanical breather retainer 220 while at the same time providing for rigidity. As illustrated, a plurality of lightening holes 224 can be formed in the retaining member. The lightening holes 224 can be spaced in a substantially mirror symmetric configuration to promote a balanced weight distribution. In other situations, where the balance of the engine 100 needs adjustment, the lightening holes 224 can be formed so as to promote overall balancing of the engine 100. The lightening holes 224 have irregular shapes in the illustrated embodiment, but the lightening holes 224 can have regular shapes such as circular, triangular or the like as well.

Figure 21:
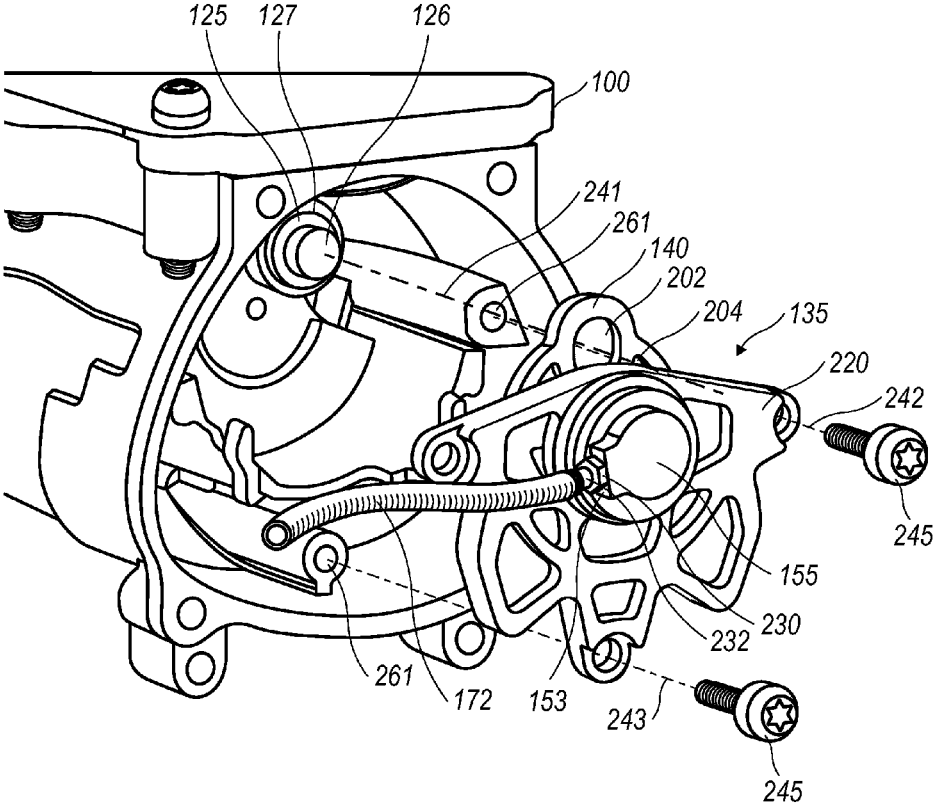
FIG. 21 is an exemplary exploded view of the example of the mechanical breather assembly of FIG. 20 in relation to an example four-stroke engine.

FIG. 21 illustrates a perspective exploded view of an assembled mechanical breather 135 with respect to an example four-stroke engine. As indicated above, the mechanical breather 135 can include a rotating member 202. The rotating member 140 can have one or more formed voids 204 and one or more receiving holes 202. The one or more receiving holes 202 can be adapted to couple a connecting member 125 of the engine 100. As illustrated in FIG. 21, the connecting member 125 has a coupling end 126 which fits within the receiving holes 202 (illustrated by assembly line 241). The connecting member 125 can be coupled directly or indirectly to the crankshaft of the engine 100. The coupling end 126 can be adapted to pass through the receiving hole 202 such that a portion of the coupling end 126 extends beyond an opposite surface of the rotating member 140. In at least one embodiment, the transition between the main portion 127 of the connecting member 125 and the coupling end 126 can be shaped to form a bearing surface upon which the rotating member 140 presses. As the crankcase is lubricated, the wear of the bearing surface of the connecting member and the side of the rotating member 140 that it touches can be minimized. In other embodiments, the rotating member 140 can be spaced such that it does not contact the main portion 127 of the connecting member 125. When the side of rotating member 140 does not contact the connecting member 125 reduced wear can be achieved.

The mechanical breather system 135 can be coupled to the engine via one or more fasteners 245. The one or more fasteners 245 can be adapted engage with corresponding one or more fastener receivers 261. The fastener axis 242, 243 are illustrated to show the correspondence between the fasteners 245 and the corresponding fastener receivers 261. As illustrated the fasteners 245 are bolts. Additionally, the fastener receivers 261 as illustrated are threaded holes formed in a portion of the engine 100. While bolts and threaded holes are illustrated, other types of fasteners and fastener receivers can be implemented to couple the mechanical breather system 135 to the engine. For example, the fasteners 245 can be screws, tapered pins, press clamps and other similar fasteners that are adapted for either permanent attachment or removable attachment. The fastener receivers 261 can be adapted to receive the selected fastener. In at least one embodiment, the fastener can be selected to be a removable fastener to allow for removal of the mechanical breather system 135, for example to allow for cleaning or replacement or additional space. As illustrated, the one or more fasteners 245 can be adapted to bear against the breather retainer 220. The breather retainer 220 in turn holds the mechanical breather system in place inside the crankcase of the engine. As mentioned above, the breather housing 155 can be coupled to the breather retainer 220.

As illustrated the breather housing 155 is on the opposite side of the rotating member 140 from the crankshaft and the connecting member 125. In this configuration, the breather housing 155 can be located close to an end of the crankcase. A crankcase cover can be placed over the end of the engine to seal the crankcase with the mechanical breather system 135 inside of the crankcase. In order to expel the crankcase gas a hose 172 can be coupled to the outlet portion 232 of the vent fitting 230. The vent fitting 230 can also be described as the exhaust stem as mentioned above. The hose 172 allows for the gas to exit the crankcase to a place such as the air intake filter another place that can be external to the crankcase. In other embodiments, the hose 172 can be connected to an emission control device. While a hose 172 is illustrated, the hose 172 can take other forms such as a channel formed in the crankcase, a rigid member, or any other configuration that allows for the expelling of air from inside the crankcase via the air receiving chamber.

Figure 22:
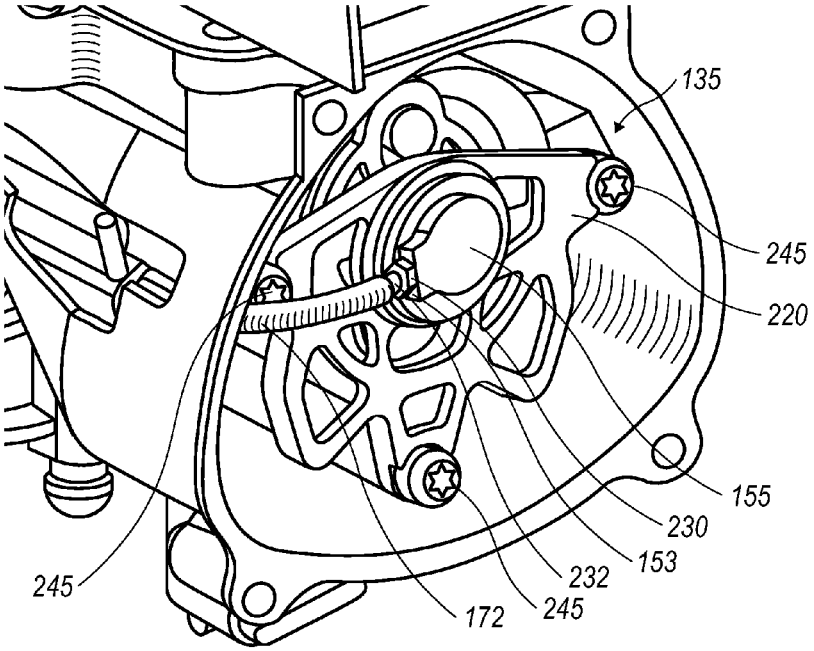
FIG. 22 is an exemplary perspective view of the example of the mechanical breather assembly of FIG. 20 installed in an example four-stroke engine of FIG. 21.

FIG. 22 illustrates a perspective view of the mechanical breather system 135 in an installed configuration. As illustrated the mechanical breather system 135 is coupled to the engine by fasteners 245. The fasteners 245 engage with the mechanical breather retainer 220 to couple the mechanical breather system 135 in place inside the crankcase of the engine. As explained earlier, the gas collected in the breather housing 155 is expelled via the vent fitting 230 and passes through the outlet 232 of the vent fitting into the hose 172 and to a point that is external to the crankcase.

Figure 23:
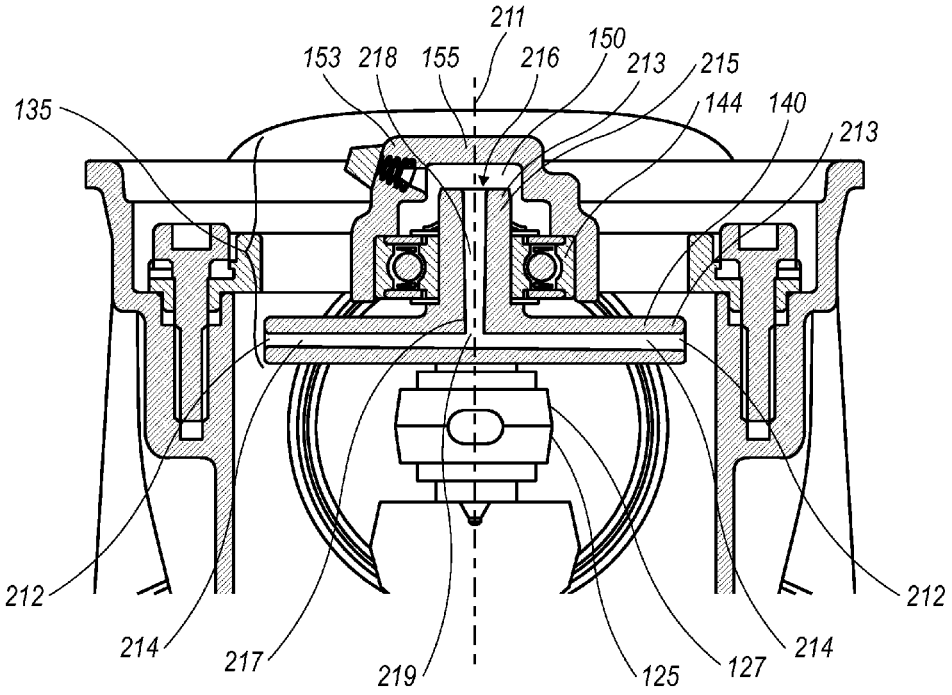
FIG. 23 is an exemplary section view of the example of the mechanical breather assembly of FIG. 20 installed in an example four-stroke engine of FIG. 21.

FIG. 23 illustrates a cross-sectional view of the mechanical breather system 135 in an installed configuration. The rotating member 140 can be coupled to a connecting member 125, which can be in turn coupled to the crankshaft. When the crankshaft rotates, the connecting member 125 rotates, and the connecting member 125 in turn rotates the rotating member 140 about its rotational axis 211. When the rotating member 140 is rotating, the inlet 212 of one of the inlet channels 214 can be spun in a rotational direction that is the same as the crankshaft. In other embodiments, the crankshaft can be indirectly coupled to the rotating member 140 such that the rotating member 140 rotates in a direction that is opposite to the rotation of the crankshaft.

As described above, when the rotating member 140 is rotating gas can enter the inlet 212 as the liquid is spun away from the inlet 212. The gas can then move in a radial direction along the inlet channel 214 towards an inner portion of the inlet channel 214. The inlet channel 214 as illustrated is of a substantially uniform cross-section. In other embodiments, the cross-section of the inlet channel 214 can vary along its length from the inlet 212 to an inner portion of the rotating member 140. In at least one embodiment the inlet 212 can be tapered such that is wider at the inlet 212 than at an inner portion of the rotating member 140. In yet another embodiment, the inlet 212 can be narrower than the inlet channel at an inner portion of the rotating member 140.

As illustrated, the rotating member 140 can include a rotating member shaft 215. The rotating member shaft 215 has a first end 217 and a second end 213 opposite the first end 217. The first end of the rotating member shaft 215 can be coupled to the rotating member 140. The rotating member shaft 215 traverses at least partially though the air receiving chamber 150. The rotating member shaft 215 can be supported for rotation by a rotating member bearing 144. The rotating member bearing 144 can be sealed on one side or completely sealed. In yet some embodiments as described above the rotating member bearing 144 could be unsealed such that both side of the bearing are open. When the rotating member bearing 144 is sealed on one side it prevents the flow of gas therethrough and also provides for lubrication. In one embodiment, the side of the rotating member bearing 144 that is open faces toward the rotating member 140.

As illustrated, the second end 213 of the rotating member shaft 215 extends beyond the rotating member bearing 144 and into the air receiving chamber 150. In other embodiments, the second end 213 of the rotating member shaft 215 can terminate just beyond the rotating member bearing 144.

In yet another embodiment, the rotating member shaft 215 can have a length such that is flush with the rotating member bearing 144. By having the end almost flush, flush or extending the bearing 144, the gas can enter the air receiving chamber 150 formed in the breather housing 155.

In order to reach the air receiving chamber 150, the gas can pass from the at least one inlet channel 214 into the at least one rotating member breathing channel 218 formed in the rotating member shaft 215. In this configuration, the at least one rotating member breathing shaft channel 218 fluidly couples the at least one inlet channel 214 and the air receiving chamber 150. The at least one rotating member breathing shaft channel 218 can be coupled via a connection region 219 to at least one inlet channel 214. The connection region 219 can be at an inner portion of the rotating member 140. The connection region 219 can be shaped to facilitate flow from the at least one inlet channel 214 to the at least one rotating member breathing channel 218. When more than one inlet channel 214 is implemented, the connection region 219 can be configured to couple the plurality of inlet channels 214 to the at least one rotating member breathing shaft channel 218. The gas flows from the connection region 219 down the at least one rotating member breathing shaft channel 218 until it reaches the exit 216 where the gas enters the air receiving chamber 150. The gas in the air receiving chamber 150 can be expelled through a passage formed in the wall 153 of the breather housing 155. As described above, a fitting can be used to provide for a passage of gas from the air receiving chamber 150 to an exterior of the breather housing 155.

As illustrated, the at least one rotating member breathing shaft channel 218 can have a varying cross-section such that the at least one rotating member breathing shaft channel 218 has a larger cross section at the opening (e.g. exit 216) of the second end 213 of the rotating member shaft than at the first end 217 of the rotating member shaft. As illustrated, the at least one rotating member breathing shaft channel 218 tapers from the first end 217 to the second end 213. Other changes in the cross-section can be constructed to allow for the desired flow characteristics. When the cross-section varies linearly as illustrated, the gas can more easily pass through at least one rotating member breathing shaft channel 218. Even though two inlet channels 214 have been illustrated, the number of inlet channels 214 should not be considered to be the only implementation of the inlet channels 214. Additionally, the shape and relative size of the inlet channels 214 can vary as well.

While only one rotating member breathing shaft channel 218 has been illustrated, in other embodiments more than one rotating member breathing shaft channel 218 can be implemented. For example, when two inlet channels 214 are implemented, there can be a rotating member breathing shaft channel 218 for each of the inlet channels 214. Similarly, when three inlet channels 214 are implemented, three rotating member breathing shaft channels 218 can be implemented such that each correspond to the respective inlet channel 214. In other embodiments, a single rotating member breathing shaft channel 218 can be implemented for a plurality of inlet channels 214. In yet other embodiments, one inlet channel 214 can correspond with one rotating member breathing shaft channel 218 and a set of plurality of inlet channels 214 can correspond with another rotating member breathing shaft channel 218.

Exemplary embodiments have been described hereinabove regarding mechanical breather systems for four stroke engines. The mechanical breather system 135 described herein can be used in relation to any type of four stroke engine, such as a half-crank four stroke engine, a full-crank four stroke engine, a four stroke engine for an outdoor power tool such as a blower, trimmer or the like, a small four stroke engine for a motored bike or scooter, or any other four stroke engine that requires ventilation of crankcase pressure.

What is claimed is:

1. A four-stroke engine comprising:

a crankshaft supported by at least one bearing, wherein the crankshaft is configured to be coupled to a connecting rod which is coupled to a piston;

a rotating member coupled to and driven by the crankshaft, said rotating member defining at least one inlet channel extending between an outer perimeter of the rotating member and an inner region of the rotating member;

a breather housing having an air receiving chamber formed within the breather housing, wherein the air receiving chamber is positioned adjacent to a portion of the at least one inlet channel of the rotating member; and a passage formed through a wall of the breather housing, wherein said passage is in fluid communication with the air receiving chamber and an exterior of the breather housing.

2. The four-stroke engine of claim 1, wherein the air receiving chamber is in fluid communication with the at least one inlet channel at the inner region of the rotating member.

3. The four-stroke engine of claim 1, wherein one bearing of the at least one bearing is coupled to the breather housing.

4. The four-stroke engine of claim 3, wherein the one bearing is coupled adjacent to an outside wall of the breather housing.

5. The four-stroke engine of claim 3, wherein the one bearing is on an opposite side of the air receiving chamber from the rotating member.

6. The four-stroke engine of claim 1, further comprising a rotating member shaft having a first end and a second end opposite the first end, wherein the first end of the rotating member shaft is coupled to the rotating member.

7. The four-stroke engine of claim 6, wherein the rotating member shaft traverses at least partially through the air receiving chamber.

8. The four-stroke engine of claim 6, wherein the rotating member shaft has at least one rotating member breathing channel formed therein, the rotating member breathing channel being fluidly coupled to the at least one inlet channel and the air receiving chamber.

9. The four-stroke engine as recited in claim 1, wherein the at least one inlet channel is formed from a vane extending between the outer perimeter of the rotating member and the inner region of the rotating member.

10. The four-stroke engine as recited in claim 1, wherein the at least one inlet channel comprises a plurality of inlet channels.

11. The four-stroke engine as recited in claim 1, wherein the at least one inlet channel is formed in the rotating member and is open on a distal end at a perimeter of the rotating member and coupled to a rotating member breathing channel formed in the rotating member shaft at the distal end.

12. The four-stroke engine as recited in claim 1, further comprising a connecting member coupling said crankshaft to the rotating member.

13. The four-stroke engine as recited in claim 1, wherein the four-stroke engine is a full-crank engine and the crankshaft is supported by at least two bearings.

14. The four-stroke engine as recited in claim 1, wherein the four-stroke engine is a half-crank engine and further comprising an extended crank pin which drives the rotating member.

15. A four-stroke engine comprising:

a crankshaft supported by at least one bearing, wherein the crankshaft is configured to be coupled to a connecting rod which is coupled to a piston;

a rotating member coupled to and driven by the crankshaft, said rotating member including a rotating member shaft having a first end and a second end opposite the first end, wherein the first end of the rotating member shaft is coupled to the rotating member;

at least one rotating member breathing shaft channel formed in the rotating member shaft, the at least one rotating member breathing shaft channel being an opening at the second end of the of the rotating member shaft;

at least one inlet channel defined by the rotating member extending between an outer perimeter of the rotating member and the at least one rotating member breathing shaft channel;

a breather housing having an air receiving chamber formed within the breather housing, wherein the air receiving chamber is fluidly coupled to the at least one rotating member breathing shaft channel; and a passage formed through a wall of the breather housing, wherein said passage is in fluid communication with the air receiving chamber and an exterior of the breather housing.

16. The four-stroke engine as recited in claim 15, wherein the at least one inlet channel comprises two inlet channels, each of which is fluidly coupled to the at least one rotating member breathing shaft channel at an inner region of the rotating member.

17. The four-stroke engine as recited in claim 15, wherein the at least one rotating member breathing shaft channel has a varying cross-section such that the at least one rotating member breathing shaft channel has a larger cross section at the opening of the second end of the rotating member shaft than at the first end of the rotating member shaft.

18. A mechanical breather for a four-stroke engine, comprising:

a rotating member adapted to be coupled to and driven by a crankshaft, configured to be coupled to a connecting rod which is coupled to a piston, of the four-stroke engine, said rotating member defining at least one inlet channel extending between an outer perimeter of the rotating member and an inner region of the rotating member;

a breather housing having an air receiving chamber formed within the breather housing, wherein the air receiving chamber is fluidly coupled at least one inlet channel of the rotating member; and a passage formed through a wall of the breather housing, wherein said passage is in fluid communication with the air receiving chamber and an exterior of the breather housing.

19. The mechanical breather as recited in claim 18, further comprising a rotating member shaft having a first end and a second end opposite the first end, wherein the first end of the rotating member shaft is coupled to the rotating member; and at least one rotating member breathing shaft channel formed in the rotating member shaft, the at least one rotating member breathing shaft channel being an opening at the second end of the of the rotating member shaft, wherein the at least one rotating member breathing shaft channel couples the at least one inlet channel and the air receiving chamber.

20. The mechanical breather as recited in claim 18, wherein the rotating member has at least one receiving hole formed therethrough for receiving a connecting member of the four-stroke engine.

* * * * *